United States Patent [19]

Herring et al.

[11] Patent Number: 4,645,471

[45] Date of Patent: Feb. 24, 1987

[54] BUSY BALL CHILD'S TOY

[75] Inventors: Donald E. Herring, Redondo Beach; Raymond J. Gross, Culver City, both of Calif.

[73] Assignee: Mattel, Inc., Hawthorne, Calif.

[21] Appl. No.: 709,469

[22] Filed: Mar. 7, 1985

[51] Int. Cl.[4] ..... A63H 1/00; A63H 5/00

[52] U.S. Cl. ..... 446/258; 446/264; 446/409; 446/431; 446/486; 273/58 K; D21/65

[58] Field of Search ..... 446/219, 227, 256, 258, 446/269, 264, 270, 279, 289, 409, 419, 431, 489, 486, 491, 339, 341, 392, 440, 465, 466, 468; D21/65, 104; 273/58 K

[56] References Cited

U.S. PATENT DOCUMENTS

| | | | |
|---|---|---|---|
| D. 269,629 | 7/1983 | Wiggs et al. | D21/104 |
| 708,706 | 9/1902 | Hazelhurst | 446/258 |
| 744,718 | 11/1903 | Cassidy | 273/58 K X |
| 1,657,071 | 1/1928 | Dailey | 446/256 |
| 2,115,986 | 5/1938 | Da Costa | 446/219 |
| 2,351,762 | 6/1944 | Hoover | 446/269 |
| 2,473,574 | 6/1949 | Davis | 446/409 X |
| 2,504,650 | 4/1950 | Chessrown | 446/409 X |
| 2,688,814 | 9/1954 | Irelan | 446/392 X |
| 3,058,261 | 10/1962 | Lakin | 446/270 |
| 3,106,397 | 10/1963 | Lacey | 446/409 X |
| 3,603,023 | 9/1971 | McHugh | 446/431 |
| 3,679,212 | 7/1972 | Smith | 273/144 B |
| 3,822,499 | 7/1974 | De Vos | 273/58 K X |
| 3,980,300 | 9/1976 | Hornsby, Jr. | 273/58 B |
| 4,284,398 | 8/1981 | Bokelmann | 425/394 |
| 4,381,620 | 5/1983 | Panzarella | 446/177 |

FOREIGN PATENT DOCUMENTS

| | | | |
|---|---|---|---|
| 141982 | 1/1935 | Austria | 273/58 K |
| 485415 | 10/1929 | Fed. Rep. of Germany | 446/256 |
| 2063087 | 6/1981 | United Kingdom | 446/431 |

*Primary Examiner*—Robert A. Hafer
*Assistant Examiner*—Terrence L. B. Brown
*Attorney, Agent, or Firm*—Ronald Goldman; Melvin Klein; Daniel Sullivan

[57] ABSTRACT

A busy ball child's toy including a generally spheroid structure having a plurality of openings, at least some of the openings being configured for captive yet rotatable retention of a generally hollow ball therein. Some of the balls may be at least partially transparent and contain an amusement element therein such as rotatable figures, beads, reflecting elements, lenticular labels, or the like. The toy is symmetrical about its center and balanced to enable the toy to be spun as a top. An interconnecting post positioned centrally relative to the balls acts as a shock absorber in the event of dropping or striking of the toy on the balls.

17 Claims, 5 Drawing Figures

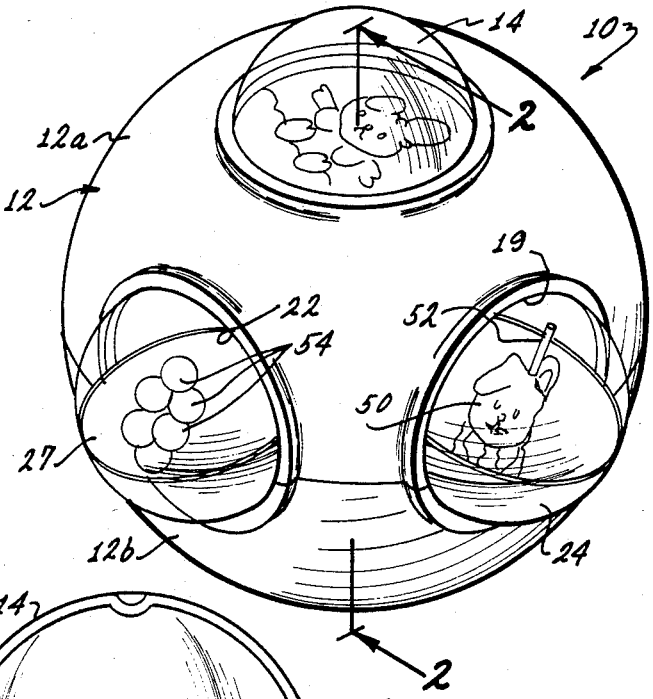
Fig. 1
Fig. 2
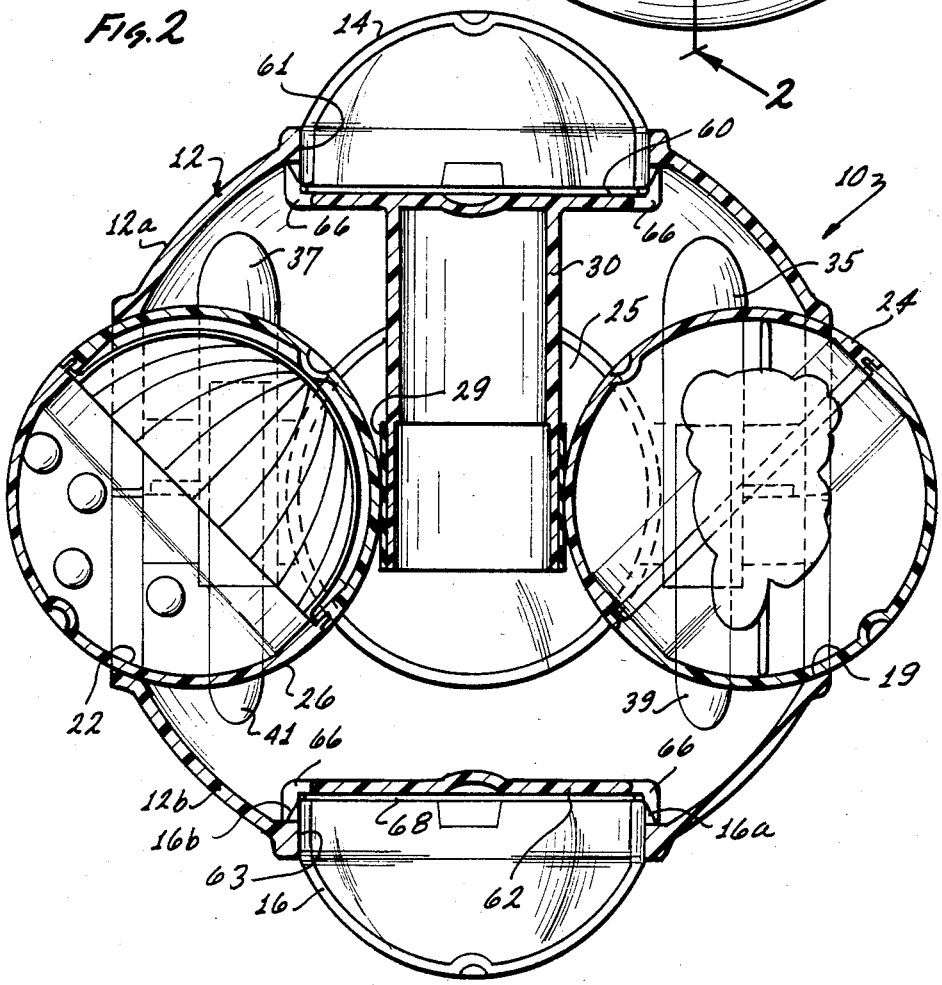

BUSY BALL CHILD'S TOY

BACKGROUND OF THE INVENTION

The background of the invention will be discussed in two parts:

FIELD OF THE INVENTION

This invention relates to children's toys, and more particularly to a busy type ball which includes transparent portions with amusement devices therein for entertaining a child of tender years.

DESCRIPTION OF THE PRIOR ART

Children of tender years, such as toddlers and infants, have limited manual dexterity, and toys for this age group have focused on devices which require little skill to operate and enjoy. Spinning objects responsive to a slight push or touch have been traditional with toddlers, and particularly spinning objects which provide some additional amusement other than the mere act of spinning. One such device has been the transparent ball with some mechanism on the interior of the ball actuated in response to the rolling motion of the ball.

A ball of this type is shown and described in U.S. Pat. No. 2,115,986, issued May 3, 1938, to Da Costa, entitled "Toy Ball". This device includes a hollow transparent sphere partly filled with a liquid having a floating figure thereon and colored articles heavier than the liquid providing a kaleidoscopic effect upon rolling. Another such ball is shown and described in U.S. Pat. No. 2,351,762, entitled "Toy", issued June 20, 1944 to Hoover, the ball being a transparent sphere and including a freely movable figure therein with the figure constructed to maintain an erect position.

U.S. Pat. No. 3,058,261, issued Oct. 16, 1962 to Lakin for an "Action Toy" depicts a generally transparent ball having a pair of figures supported on a floating shaft of lesser diameter than the interior diameter, whereby rotation of the ball causes rocking, spinning or tumbling of the figures.

A similar type device is shown and described in U.S. Pat. No. 4,381,620, issued to Panzarella May 3, 1983, for an "Action Device with Confined Action Element", the device including a stand having a yoke supporting a spherical hollow ball with a pair of aligned stub shafts, the ball having an action element on the interior with a spindle supported in a pair of slots, which upon rotation of the ball along its axis causes rotation of the element on its axis within the confines of the slots.

A different type of ball is shown and described in U.S. Pat. No. 3,980,300 issued Sept. 14, 1976 to Hornsby, Jr. for an "Amusement Ball", the ball having an outer transparent cover with an inner sphere of smaller diameter to create a space therebetween, with this space filled with a crystalline material.

A "Chance Readout Educational Ball" is shown and described in U.S. Pat. No. 3,679,212, issued to Smith, with the ball having a plurality of apertures in the surface thereof, with pellets on the interior thereof with each pellet having indicia thereon. Each pellet is shaped to fit partially into the apertures from the interior.

A method of, and apparatus for, making a ball is described in U.S. Pat. No. 4,284,398, issued to Bokelmann, Aug. 18, 1981, and entitled "Apparatus for the Manufacture of a Foam Material Ball with an Embossed Surface".

It is an object of the present invention to provide a new and improved ball device having amusement elements.

It is another object of the present invention to provide a new and improved ball device having a plurality of rotatable portions with a plurality of amusement elements.

It is a further object of the present invention to provide a new and improved ball device having a plurality of generally hollow, generally spherical ball members rotatably and captively retained in a spheroid framework.

SUMMARY OF THE INVENTION

The foregoing and other objects are accomplished by providing a generally spheroid structure having a plurality of openings, at least some of the openings being configured for captive yet rotatable retention of a generally hollow ball therein. Some of the balls may be at least partially transparent, and contain an amusement element therein such as rotatable figures, beads, reflecting elements, lenticular labels, or the like. The toy is symmetrical about its center and balanced to enable the toy to be spun as a top. An interconnecting post is positioned centrally relative to the balls to act as a shock absorber in the event of dropping or striking of the toy on the balls.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the busy ball child's toy according to the present invention;

FIG. 2 is an enlarged view, partially in cross-section, of the busy ball toy of FIG. 1 as viewed generally along line 2—2 thereof;

DESCRIPTION OF THE PREFERRED EMBODIMENT

Figure 3:
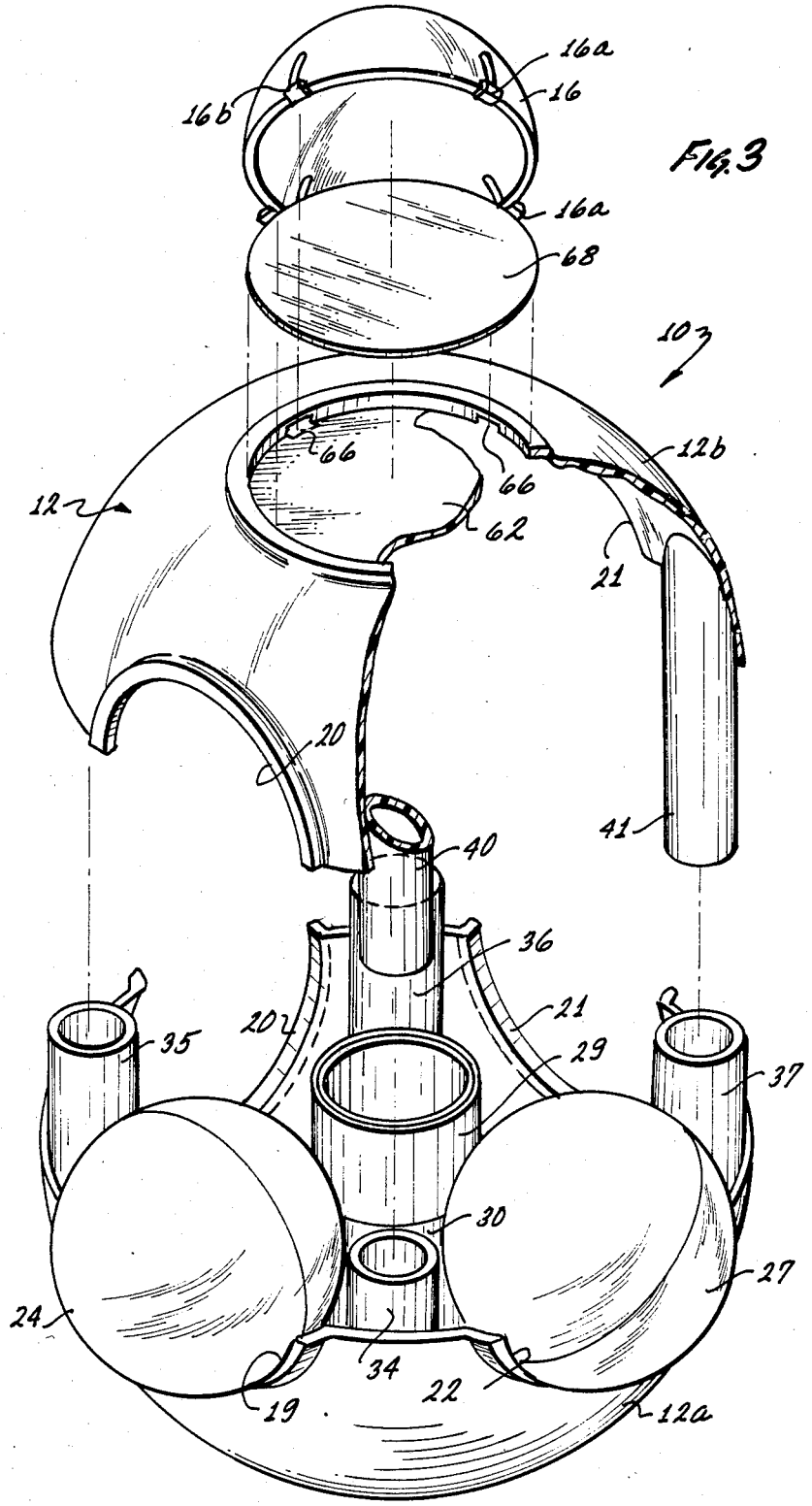
FIG. 3 is an exploded perspective view of the busy ball toy of FIG. 1 in inverted position relative to FIG. 2, illustrating two of the balls and a hemisphere portion for use therein.

Referring now to the drawings, and particularly to FIGS. 1 through 3, there is shown a busy ball child's toy, generally designated 10, including a spheroid structure 12, formed of first and second spheroid halves **12*a* and 12*b*, which when joined together form a generally hollow structure. For ease of discussion, the relative directions and orientations to be used with respect to the description of the busy ball toy 10** will be that terminology associated with the earth, such as polar, equatorial and the like, and it is to be understood that these descriptions are applied with reference to the drawings and are not intended to be structurally limiting.

As shown in the drawings, the spheroid structure 12 of the toy 10 includes first and second generally transparent polar domes 14 and 16, of generally hemispherical configuration. Equiangularly disposed about the equator thereof at the junction of the two spheroid halves 12*a* and 12*b*, there are a plurality of generally circular openings 19–22, each of the openings having an arcuately formed lip for forming socket means for captively yet rotatably supporting therein one of a plurality of generally hollow at least partially transparent ball members 24–27, respectively. As will be hereinafter described, at least some of the ball members 24–27, as well as each of the domes 14 and 16, have positioned therein for viewing therethrough, some amusement element, which may be static or dynamic, that is a static element could be for example, a picture, a reflector element or the like, while a dynamic element could be a spinning or rotatable device, either captive or floating.

As illustrated in FIGS. 2 and 3, for interconnection and securing, the spheroid halves 12*a* and 12*b* are configured with the interiors thereof having integrally formed radially extending interconnecting members. That is, spheroid half 12*a* is provided with a plurality of tubular members 34–37 spaced from and generally parallel to a central tubular post portion 30 which extends down between ball members 24–27, as explained more fully below. These tubular members are at positions intermediate the openings 19–22 for interconnection with matingly configured and aligned telescopically engaging post members 39, 40 and 41, only three of which are shown. Each of the interconnecting members 34–37 and 39–41 has a length which extends beyond the plane of the rim or edge of the respective spheroid half 12*a* or 12*b* of which it is a part, with the two halves 12*a* and 12*b* being assembled by telescopically engaging the relative aligned parts whereupon the rims of the two halves 12*a* and 12*b* are in abutting relation. The parts may be configured for frictional securing or may be glued or welded, as desired.

The centers of the openings 19–22 lie in a common plane generally perpendicular to the longitudinal center line of the post member 30, with the angles between adjacent centers of the openings 19–22 being generally equal, that is with four openings 19–22, the angle between adjacent openings is ninety degrees. The tubular post 30 acts as a shock absorber due to its inherent resiliency, if the toy is dropped or struck on one of the balls 24–27.

Each of the ball members 24–27 have generally identical diameters, each is formed in two halves, and each is formed as a generally hollow member with an outer diameter slightly greater than the diameter of each of the openings 19–22, and a diameter smaller than the diameter of the spheroid 12. In the toy 10, the diameter of the ball members 24–27 is slightly less than the radius of the spheroid 12, with the diameter of post member 30 sufficient to provide a small amount of spacing between the outer circumference of post member 30 thereof and the periphery of the ball members 24–27 with the ball members assembled in the socket openings 19–22, respectively, as best shown in FIG. 2. This spacing and the arcuate lip of each of the openings 19–21 permits rolling or rotation of the ball members 24–27 within the socket openings as the ball toy 10 is rolled, or alternatively permits rolling of the individual ball members 24–27 while holding the ball toy 10, for viewing a preselected one of the amusement elements. To aid in rolling or turning of the individual ball members 24–27, a layer of material 29, such as an ultra-high molecular anti-friction, or self-lubricating tape, is added to or wound around post 30 adjacent the ball members 24–27. This layer or tape lessens the friction therebetween.

The amusement elements may include static or dynamic devices, static devices being defined as a solid or multi-colored ball, or device which maintains a given position within one of the ball members 24–27 regardless of the rotation of the ball member. Dynamic amusement elements, on the other hand are devices within one of the ball members 24–27 which roll, spin, or tumble upon rotation of either the ball member 24–27, themselves, or the toy 10 itself, and such device may include, for example, any one of the action devices previously described in connection with the prior art.

Figure 4:
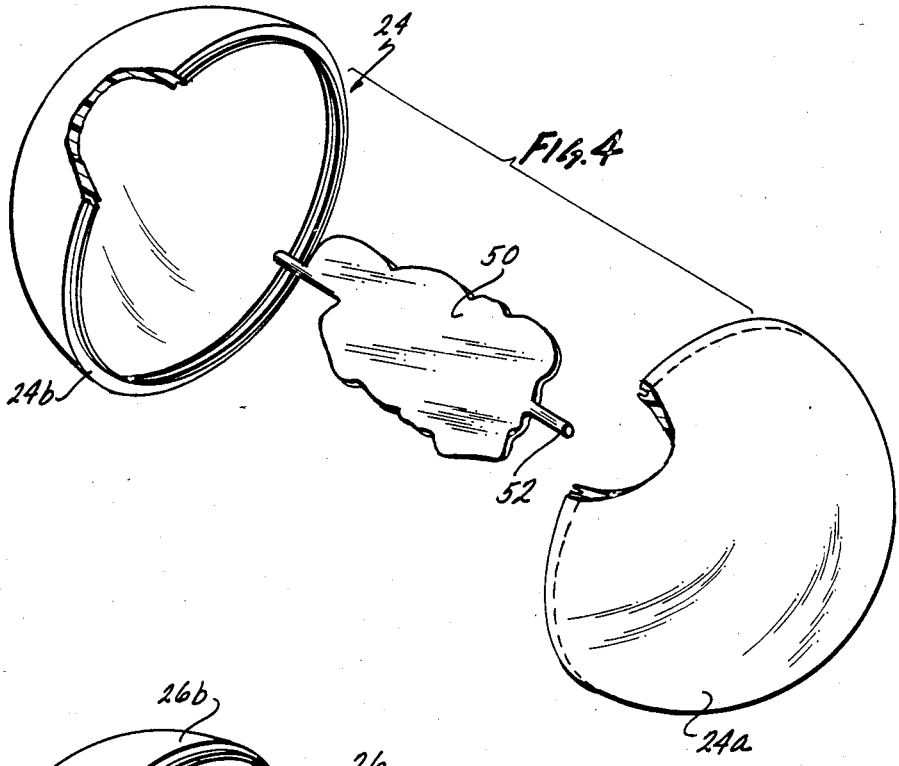
FIG. 4 is an exploded perspective view of one of the balls used in the busy ball toy of FIG. 1, such ball having a rotatable figure therein.

By reference to FIG. 4, specifically, and FIG. 2, generally, one such dynamic amusement element may include a simulated FIG. 50 having a shaft 52 generally along a line including the center of gravity of the combined unit, or slightly offset from the center of gravity to provide a preferred position of the FIG. 50 at rest. The FIG. 50 may take any convenient form with which a child of tender years has familiarity, such as a bunny. With this particular amusement element, it is preferable that at least one of the ball member halves 24*a* or 24*b* be formed of a generally transparent material, although it is to be understood that either of the halves may be a colored transparent material, or two different colors of transparent material.

Figure 5:
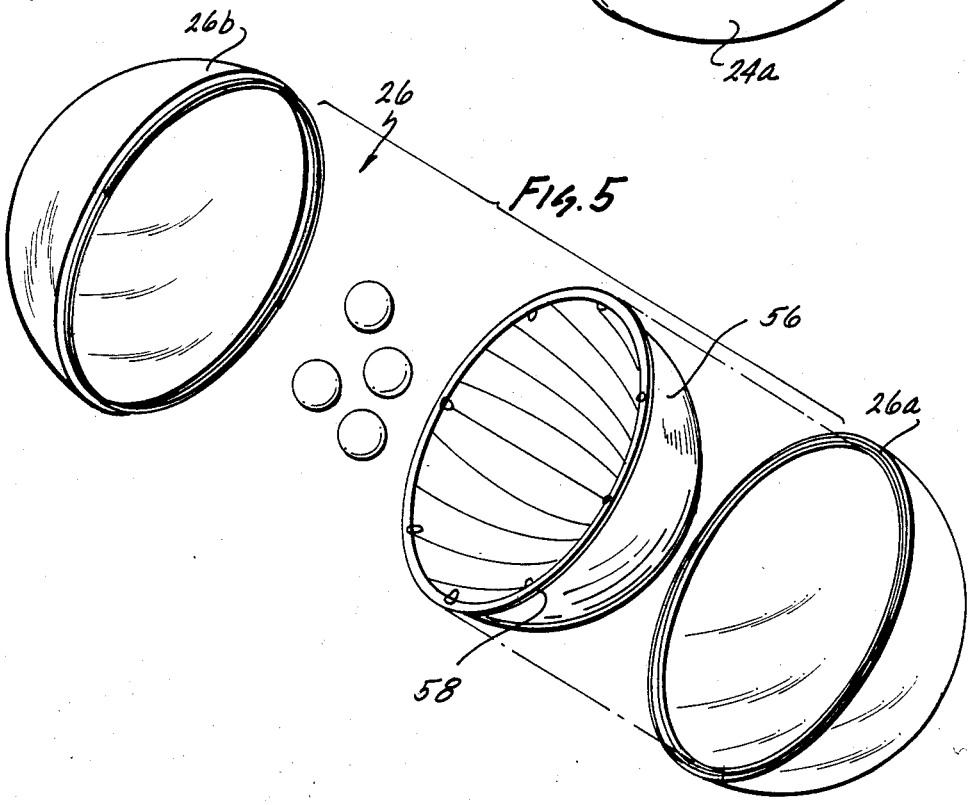
FIG. 5 is an exploded perspective view of another of the balls used in the busy ball toy of FIG. 1, such ball having beads and a faceted hemispherical reflector therein.

By reference to FIG. 5, specifcally, and FIG. 2, generally, the interior of the ball member 26 may be provided with a plurality of varicolored beads 54, with a faceted hemispherical reflector element 56 being positioned or secured within the interior of the ball member 26. Preferably, the faceted reflector element has a diameter approximately equal to the inner diameter of the ball member 26, and may be formed in one piece from any convenient material, such as ABS metallized plastic. The faceted inner reflecting surface acts as a concave lens and provides distortions of the reflections of the varicolored beads upon rotation of the ball member 26. For ease of assembly, the reflector element 56 includes an outwardly extending peripheral lip portion 58, which is received between the halves 26*a* and 26*b* of the ball member 26. With the reflector element 56 being received within half 26*a*, this half need not be transparent but may be a colored hemisphere, with ball half member 26*b* being formed of a transparent material.

At the polar extremes of the spheroid structure 12, by reference to FIGS. 2 and 3, at the opposite ends of the post member 30, and integrally formed within the structure 12, there are first and second cup-shaped recesses or portions 60 and 62, respectively. Each of the recesses 60 and 62 has an opening 61 and 63, respectively, formed in the surface of the spheroid structure 12, with the base of each of the portions 60 and 62 having a plurality of spaced slots 66 formed at the outer bottom edge thereof (see FIGS. 2 and 3) for receiving therein tangs 16*a*, 16*b* formed about the bottom edge of the dome member 16. The dome member 14 is similarly configured for being received within the cup-shaped recess 60.

Positioned in each of the recesses 60 and 62 is a static amusement element, such as a disc 68, shown in FIG. 3, the disc 68 preferably having an optical image altering surface, such as a mirrored surface, or a lenticular label, the latter being in the nature of a corrugated or grooved surface on which a first image is viewed when the eye is at a given angle to the surface, and a second image is viewed when the eye is at a different angle to the surface. In either event, the disc 68 has a diameter closely approximating the diameter of the base of the recess 60 or 62, the disc 68 is positioned within the recess 26, with the dome member 16 being snapped into place within the recess 62 with the tangs 16*a* engaging the aligned slots 66 for securing the dome member 16 therein.

The toy 10 is symmetrical about its center with the spheroid structure 12 preferably formed of a colored translucent plastic material. The toy 10 is balanced so that it may act as a spinning top about any of the protruding portions of the polar domes 14, 16 or the ball members 24–27. Again, this is due to the fact that the entire toy 10 is symmetrical about its center. Each of the ball members 24–27 may have some portion thereof transparent, with an amusement element in such ball members preferably, although not necessarily being dynamic elements. Although the dome members 14 and 16 have been described as having static reflecting elements, such as mirrors or lenticular labels therein, it is to be understood that varicolored beads, or bells may be inserted therein, and accordingly it is not intended that the invention be limited to the precise amusement elements herein described. In addition, although four ball members 24–27 are referred to, a lesser, or greater number may be conveniently employed.

While there has been shown and described a preferred embodiment, it is to be understood that various other adaptations and modifications may be made within the spirit and scope of the invention.

We claim:

1. A toy ball device comprising:

a generally hollow structure having a generally spherical outer surface;

diametrically extending generally tubular post means within said generally spherical structure;

a plurality of openings in said structure configured for forming socket means;

a plurality of ball members configured for being received within said socket means with a portion thereof extending beyond the outer surface of said structure, said socket means and said post means being configured for captively retaining said ball members therein and for permitting rotation of said ball members with respect thereto, at least one of said ball members being generally hollow and having an at least partially transparent surface; and an amusement element generally contained within said at least one ball member.

2. The combination according to claim 1 wherein said post means has the outer diameter thereof in proximate relation to said at least some of said ball members, and said post means is at least partially resilient to act as a shock absorber against sudden impact of said toy.

3. The combination according to claim 2 further including anti-friction means on said post means in proximity to said at least some of said ball members for facilitating rotation of said ball members.

4. A toy ball device comprising:

a generally hollow structure having a generally spherical outer surface and having a diametrically extending post means therein;

a plurality of openings in said structure having the centers thereof lying in a common plane generally perpendicular to said post means, each of said openings having an arcuate lip portion about the periphery thereof configured for forming socket means;

a plurality of ball members configured for being received within said structure intermediate said socket means and said post means with a portion of said ball members extending beyond the outer surface of said structure, said socket means and said post means captively retaining said ball members therein while permitting rotation of said ball members with respect to said structure, at least one of said ball members being generally hollow and having an at least partially transparent surface; and an amusement element generally contained within said at least one ball member.

5. The combination according to claim 4 wherein said amusement element is movable within said at least one ball member.

6. The combination according to claim 4 wherein said toy ball device includes at least four openings and at least four generally hollow ball members, and at least some of said ball members have an at least partially transparent surface.

7. The combination according to claim 6 wherein said at least one of said some of said ball members includes a movable amusement element therein.

8. The combination according to claim 4 wherein said structure further includes diametrically opposed cup-shaped recesses in general alignment with said post means and generally transparent generally hemispherical dome members having the open end thereof engaged within said recesses.

9. The combination according to claim 8 further including optical means within said recesses for providing images viewable through said dome members.

10. The combination according to claim 4 further including anti-friction means on said post means in proximity to said ball members for facilitating rotation of said ball members.

11. The combination according to claim 4 wherein said toy ball device is symmetrical about its center for enabling said toy to be spun as a top about a point on the surface of one of said ball members.

12. The combination according to claim 4 wherein said structure includes at least two diametrically opposed socket means.

13. The combination according to claim 12 wherein said structure includes four socket means having the centers thereof lying in a common plane including a diameter of said structure.

14. The combination according to claim 13 wherein at least two of said ball members have at least partially transparent surfaces.

15. The combination according to claim 14 wherein at least one of said ball members with an at least partially transparent surface includes an amusement element which is movable within said at least one ball member upon rotation of one of said structure and said at least one ball member.

16. The combination according to claim 13 wherein said toy ball device further includes first and second generally cup-shaped portions in said structure at opposite ends of a line generally perpendicular to said common plane and generally transparent dome members attached to said cup-shaped portions, the outer surfaces of said dome members extending beyond the outer surface of said structure.

17. The combination according to claim 16 wherein said cup-shaped portions include static optical devices for providing images viewable through said dome members.

* * * * *